United States Patent [19]

Ueno et al.

[11] Patent Number: 4,758,242

[45] Date of Patent: Jul. 19, 1988

[54] METHOD FOR TREATING POLYESTER FIBERS HAVING MELT ANISTROPHY

[75] Inventors: Katsuji Ueno, Hirakata; Hiroaki Sugimoto, Takatsuki; Kazuo Hayatsu, Ibaraki, all of Japan

[73] Assignee: Sumitomo Chemical Company, Limited, Osaka, Japan

[21] Appl. No.: 18,781

[22] Filed: Feb. 24, 1987

Related U.S. Application Data

[63] Continuation-in-part of Ser. No. 702,583, Feb. 19, 1985 abandoned.

[30] Foreign Application Priority Data

Feb. 24, 1984 [JP] Japan ..... 59-34944

[51] Int. Cl.[4] ..... D06M 13/00

[52] U.S. Cl. ..... 8/115.69; 8/DIG. 4; 525/437

[58] Field of Search ..... 8/115.68, 115.69, 130.1, 8/DIG. 4, 115.54; 525/437

[56] References Cited

U.S. PATENT DOCUMENTS 2,998,296 8/1961 Hennemann .....`8/DIG. 4

4,008,044 2/1977 Latta ..... 8/DIG. 4

*Primary Examiner*—A. Lionel Clingman

*Assistant Examiner*—John F. McNally

*Attorney, Agent, or Firm*—Stevens, Davis, Miller & Mosher

[57] ABSTRACT

A method for treating fibers to obtain treated fibers suitable as a reinforcing material which comprises treating a fiber obtained from a polyester which shows anisotropy in the molten state in an aqueous solution of at least one compound selected from the group consisting of hydroxides, carbonates, bicarbonates, and organic carboxylic acid salts of lithium, sodium, potassium, magnesium and calcium at 20° to 120° C. for at least one minute.

The above-mentioned treatment provides treated fibers suitable as a reinforcing material which exhibit an excellent adhesion to matrices to be reinforced and can give a satisfactory strength to the resulting composite material.

2 Claims, No Drawings

METHOD FOR TREATING POLYESTER FIBERS HAVING MELT ANISTROPHY

This application is a continuation of application Ser. No. 702,583, filed Feb. 19, 1985, now abandoned.

This invention relates to a method for treating fibers to obtain treated fibers suitable as a reinforcing material. More particularly, it relates to a method for treating fibers to obtain treated fibers suitable as a reinforcing material which exhibit an excellent adhesion to matrices to be reinforced and can give a satisfactory strength to the resulting composite material.

Fibrous materials which are known as a reinforcing material suitable to be used in composite materials include glass fibers, carbon fibers, alumina fibers, steel fibers and aramid fibers. It has recently been revealed, as disclosed for example in Japanese Patent Publication No. 20,008/80, that some kinds of polyesters show anisotropy in the molten state and give, by melt spinning, fibers exhibiting a high tenacity and a high modulus of elasticity. These fibers are expected to be suitable as a reinforcing material used in forming composite material when their light weight is taken into consideration together with above-mentioned excellent properties. However, when a composite material was formed by using various kinds of thermosetting resins or thermoplastic resins as the matrix and using a fiber formed of the polyester showing anisotropy in the molten state mentioned above as the reinforcement, it turned out that there exists a big problem to be confronted. Namely, the adhesion at the interface between the reinforcement, the fiber, and the matrix, the resin, in the composite material is not sufficiently good and consequently such physical properties in which the adhesiveness between the matrix and the reinforcement is an important factor as, for example, the shear strength cannot be fully manifested.

It has been known for polyester fibers used for apparel such as those of polyethylene terephthalate to subject them to an alkaline treatment in order to reduce the hardening of cloth or to give a soft (silky) feeling to knitted goods, making them more like natural fibers. (See, for example, U.S. Pat. No. 2,781,242 and U.K. Patent No. 652,948).

However, it has not been known to apply such a treatment to polyester fibers to be used as a reinforcement.

The present inventors made extensive studies to improve the above-mentioned particular polyester fibers for a reinforcement which show anisotropy in the molten state. As a result, it has been found that treated fibers which exhibit an excellent adhesion to matrices to be reinforced and can give a satisfactory strength to the resulting composite material as a whole can be obtained by subjecting said fibers to a specified treatment.

Thus, this invention relates to a method for treating fibers which comprises treating a fiber obtained from a polyester which shows anisotropy in the molten state in an aqueous solution of at least one compound selected from the group consisting of hydroxides, carbonates, bicarbonates, and organic carboxylic acid salts of lithium, sodium, potassium, magnesium and calcium at 20° to 120° C. for at least one minute.

The "polyester which shows anisotropy in the molten state" referred to in this invention means such a polyester which, when a specimen thereof is placed between two polarizers crossed at 90° and heated to raise its temperature, permits passage of polarized light through it in the molten state. Such polyesters include polyesters whose principal chains are formed of suitable combinations of an aromatic dicarboxylic acid such as terephthalic acid, isophthalic acid, naphthalene-2,6-dicarboxylic acid, 4,4'-dicarboxydiphenyl and 1,2-bis(4-carboxyphenoxy)ethane and an aromatic diphenol such as hydroquinone, chlorohydroquinone, phenylhydroquinone, resorcinol, 4,4'-dihydroxydiphenyl, and 2,6-dihydroxynaphthalene, and/or an aromatic hydroxycarboxylic acid such as p-hydroxybenzoic acid, m-hydroxybenzoic acid and 2-hydroxynaphthalene-6-carboxylic acid. Preferred examples of polyesters formed of the above combinations are as follows:

(1) Copolyesters formed of 40 to 70% by mole of p-hydroxybenzoic acid, 15 to 30% by mole of the above-mentioned aromatic dicarboxylic acid, and 15 to 30% by mole of the aromatic diphenol.

(2) Copolyester formed of terephthalic acid and/or isophthalic acid, and chlorohydroquinone, phenylhydroquinone and/or hydroquinone.

(3) Copolyesters formed of p-hydroxybenzoic acid and 2-hydroxynaphthalene-6-carboxylic acid.

The above-mentioned polyesters may be prepared by using known methods, for example suspension polymerization, bulk polymerization and interfacial polymerization. The resulting polyesters are preferably heat-treated before spinning under atmospheric or reduced pressure.

The above-mentioned polyesters can be formed into fibers by using conventional melt-spinning equipments. The fibers thus obtained can be used as such or can be heat-treated, or stretched, or further heat-treated to be treated according to this invention. The fibers thus obtained comprise highly oriented molecules, are highly crystalline, and hence exhibit a high tenacity and a high modulus of elasticity.

The fibers are then treated in an aqueous solution of at least one compound selected from the group consisting of hydroxides, carbonates, bicarbonates, and organic carboxylic acid salts of lithium, sodium, potassium, magnesium and calcium, whereby the adhesive property of the surface of the fiber is improved, resulting in full manifestation of the strength of a composite material obtained when the fiber is combined with a matrix.

Preferred examples of the above-mentioned compounds are as follows: lithium hydroxide, lithium carbonate, lithium bicarbonate, lithium acetate, sodium hydroxide, sodium carbonate, sodium bicarbonate, sodium acetate, potassium hydroxide, potassium carbonate, potassium bicarbonate, potassium acetate.

The concentration of the compound in the aqueous solution should be 0.1% by weight or more, and is preferably 0.1 to 30% by weight, more preferably 1 to 20% by weight.

The treatment of fibers can be conducted by such methods as treating the fibers batchwise for a predetermined period of time or passing them continuously through a treating bath. The fibers to be treated may be in various forms including filaments, yarns, ropes or woven goods.

The temperature for the treatment is preferably 60° to 100° C. to enhance the effect of the treatment. The period of time for the treatment may be suitably selected to obtain a good result but should be at least one minute. By examination of reproducibility of repeated such treatments, a period of 10 minutes or more has been found preferable. Further, auxiliaries for the treatment such as quaternary ammonium salts or surface active agents may be added to the treating solution.

The fibers subjected to the above treatment can be combined with thermosetting resins or thermoplastic resins into composite materials by using various methods of processing. These methods include, for example, filament winding, lay-up method, premix method and granulation-blending. Resins which can be combined with the fibers treated according to this invention include epoxy resins, unsaturated polyester resins, phenol resins, silicone resins, rubbers, diallyl phthalate resins, polyolefins, polyesters, polyamides, polyamide-imides, polyethers, polysulfones, polysulfides and polyketones. The composite materials formed of these resins and the fibers can be used in various fields of applications such as aeroplanes, ships, vehicles, housing, sporting goods, household electric appliances, or construction and information industry.

This invention will be illustrated in more detail below with reference to Examples, which are only for the purpose of illustration and should not be construed as limiting the scope of this invention.

REFERENTIAL EXAMPLE 1

Into a polymerization vessel were placed simultaneously 1080 g (6 moles) of p-acetoxybenzoic acid, 249 g (1.5 moles) of terephthalic acid, 83 g (0.5 mole) of isophthalic acid, and 540 g (2 moles) of 4,4'-diacetoxydiphenyl. Under nitrogen atmosphere and with stirring, the resulting mixture was brought from 180° to 330° C. over a period of 2 hours and polymerized at 330° C. for 3 hours. During the course of the polymerization, acetic acid resulting from the reaction was removed out of the system. The yield of the polymer taken out after cooling was 1344 g (99.4% of theoretical). The polymer was pulverized and then treated in a nitrogen gas stream at 280° C. for 3 hours. The polymer powders thus obtained were placed on a heating sample stage positioned between two polarizing plates crossed at 90° and their behavior was observed while heating. The flow of the polymer could be confirmed from about 300° C. upward and the quantity of transmitted polarized light increased with the increase of fluidity, revealing that the polymer showed melt anisotropy. The polymer powders were melt-spun through an extruder-type spinning machine having a diameter of 30 mm at 360° C. into a continuous fiber having a filament number of 50. The fiber was then heat-treated in the air at 310° C. for 30 minutes. There was obtained a fiber having a tenacity of 310 kg/mm$^2$, an elongation of 2.8%, a modulus of elasticity of 12.8 t/mm$^2$ and a fiber diameter of 20 $\mu$m.

REFERENTIAL EXAMPLE 2

Into a polymerization vessel were placed simultaneously 1,364 g (5.05 moles) of 2,5-diacetoxybiphenyl and 830 g (5.00 moles) of terephthalic acid, and the mixture was polymerized with stirring in nitrogen atmosphere under the same conditions as in Referential Example 1. The yield of polymer was 1,517 g (95.5% of theoretical). The polymer was pulverized and then heat-treated in nitrogen atmosphere at 290° C. for 3 hours. When the polymer was examined under a polarized light for its melting behavior, the flow of the polymer could be observed from 315° C. upward and an increase in the quantity of transmitted polarized light could be confirmed simultaneously with the beginning of the flow, revealing that the polymer had a melt anisotropy.

After melt spinning and heat-treatment in nitrogen atmosphere at 310° C. for 3 hours there was obtained a continuous fiber having a filament number of 50, a tenacity of 280 kg/mm$^2$, an elongation of 3.0%, a modulus of elasticity of 10.9 t/mm$^2$ and a fiber diameter of 22 $\mu$m.

EXAMPLE 1

The fiber obtained in Referential Example 1 was treated in an aqueous sodium hydroxide solution. The volume of the aqueous sodium hydroxide solution (16.4% by weight) was 500 ml, the quantity of the fiber treated 53 g, the treating temperature 70° C. and the treating time 15 minutes.

After washed thoroughly and dried, the treated fiber was formed into a pre-preg with an epoxy resin to examine its properties as a composite material according to the following procedures.

The fiber wound round a bobbin was passed under a tension through a bath containing a methyl cellosolve solution of an epoxy resin, Sumiepoxy ELM-434 (mfd. by Sumitomo Chemical Co., Ltd.) epoxy resin concentration: 50%) and wound a drum having a circumference of 66 cm. An amine-type curing agent had been added to the epoxy resin solution. The bundle of fibers impregnated with resin on the drum was cut into a sheet 66 cm in length and 20 cm in width and then heat-treated at 130° C. for 20 minutes to increase the viscosity. The sheet was folded in the fiber direction so as to have a width of about 6 mm. Several of the thus folded sheets were put in piles into a mold of 6 mm width and pressed at 170° C. for 1 hour to give a thickness of the formed article of 2 mm. The composite material was so designed beforehand that the volume fraction of the fiber ($V_f$) in the material might become 50 to 60%. The formed article was then postcured at 200° C. and a block having a dimension of 20 mm (length)×2 mm (thickness)×6 mm (width) was cut out therefrom to determine the interlaminar shear strength (ILSS) by the three-points bending method. The determination was conducted at a span between the supporting points of 4 times the thickness of the formed article and a crosshead speed of 1 mm/min. The ILSS was calculated from the following equation.

$$ILSS = \frac{3}{4} \times \text{(Breaking load)}/\text{(Specimen width)} \times \text{(Specimen thickness)}$$

The number of specimens used in the determination was 10.

The volume fraction of the fiber ($V_f$) in the epoxy composite material containing the fiber was determined by first measuring the weight of the fiber by dissolving out the epoxy resin with tetrahydrofruan from the material in semi-cured state and the calculating its proportion in the total weight of the formed, cured article. The value of $V_f$ in this Example was 53%. The value of ILSS is shown in Table 1. It can be seen that the ILSS is markedly increased as compared with that of a composite material formed of an untreated fiber as described below. Thus, the effect of the treatment of this invention is apparent.

COMPARATIVE EXAMPLE 1

An epoxy resin composite material was prepared in the same manner as in Example 1 except that the same fiber was used without being subjected to the treatment of this invention. The volume fraction of the fiber ($V_f$) in the composite material was 55%. The value of ILSS, as indicated in Table 1, shows that the composite material does not possess a satisfactory strength because of insufficient adhesion between the fiber and the resin.

TABLE 1

Effect of fiber surface treatment on ILSS

| Example | Treatment of this invention | $V_f$ (%) | ILSS (kg/mm$^2$) |
|---|---|---|---|
| Example 1 | Yes | 53 | 9.4 |
| Comparative Example 1 | No | 55 | 3.9 |

EXAMPLE 2

Epoxy resin composite materials of varying volume fractions of fiber ($V_f$) were prepared by using the same fiber and subjecting it to the same treatment as in Example 1. The ILSS values of the materials obtained are shown in Table 2. It can be seen that the ILSSs are all improved as compared with that in Comparative Example 1.

TABLE 2

ILSS at varying $V_f$ in composite material

| $V_f$(%) | ILSS (kg/mm$^2$) |
|---|---|
| 44 | 8.0 |
| 49 | 9.0 |
| 53 | 9.4 |
| 57 | 8.3 |
| 61 | 9.0 |

EXAMPLE 3

The same fiber as that used in Example 1 was subjected to the same treatment but under different conditions. The volume of the aqueous sodium hydroxide solution (6.4% by weight) was 500 ml, the quantity of the treated fiber 52 g, the treating temperature 80° C., and the treating time 20 minutes.

The treated fiber was formed into a composite material together with an epoxy resin and the ILSS of the resulting material was determined in the same manner as in Example 1. The volume fraction of the fiber ($V_f$) in the specimen was 59% and the ILSS was 7.6 kg/mm$^2$. The strength is improved as compared with that in Comparative Example 1, showing clearly the effect of the method of this invention.

EXAMPLE 4

The same fiber as that used in Example 1 was subjected to a similar treatment using an aqueous potassium hydroxide solution. An 16.8% by weight aqueous potassium hydroxide solution was used. The treating temperature was 70° C. and the treating time was 15 minutes.

An epoxy resin composite material was prepared in the same manner as in Example 1 by using the fiber thus treated and its ILSS was determined. The volume fraction of the fiber ($V_f$) in the composite material was 57% and the ILSS was 8.2 kg/mm$^2$. It shows clearly the effect of the treatment of this invention.

EXAMPLE 5

The fiber prepared in Referential Example 2 was treated in a similar manner to that in Example 1 in a 16.4% by weight aqueous sodium hydroxide solution at 80° C. for 20 minutes.

An epoxy resin composite material was prepared by using the fiber thus treated and the ILSS was determined. The result obtained was shown in Table 3 along with that obtained when an untreated fiber was used.

COMPARATIVE EXAMPLE 2

An epoxy resin composite material was prepared under the same conditions as in Example 5 but by using a fiber not subjected to the treatment of this invention, and its interlayer shear strength (ILSS) was determined. The result is shown in Table 3.

It will be evident that the treatment of this invention gives a marked effect.

TABLE 3

Effect of fiber surface treatment on ILSS

| Example | Treatment of this invention | $V_f$ (%) | ILSS (kg/mm$^2$) |
|---|---|---|---|
| Example 5 | Yes | 55 | 8.8 |
| Comparative Example 2 | No | 54 | 3.6 |

EXAMPLE 6

A test of reinforcing polybutylene terephthalate was conducted by using the fiber subjected to the treatment according to this invention in Example 1. The polybutylene terephthalate used was Toray 1401 (mfd. by Toray Co.)

The fiber was used as it was in the form of a long fiber and, together with the resin, extruded and pelletized by using a 30 mm twin-screw kneader-extruder PCM-30 (mfd. by Ikegai Tekko K.K.). The weight ratio of the fiber to the resin was 30:70. Dumbbell test peices were molded by using a Neomat 1-oz. injection molding machine (mfd. by Sumitomo Shipbuilding & Machinery Co.) at a molding temperature of 270° C. and a mold temperature of 80° C. The test piece was subjected to a tensile test with a distance between checks of 40 mm and a stretching velocity of 5 mm/min. The results obtained are shown along with those in Comparative Example 4 below in Table 4.

COMPARATIVE EXAMPLE 4

A polybutylene terephthalate composite material was prepared in the same manner as in Example 6 but by using a fiber not subjected to the treatment of this invention. The properties of the material obtained were determined and the results were shown in Table 4. The effect of the treatment of this invention can be clearly noticed.

TABLE 4

Comparison of properties of polybutylene terephthalate composite materials

| Example | Treatment of this invention | Tensile strength (kg/cm$^2$) | Tensile modulus of elasticity (t/cm$^2$) |
|---|---|---|---|
| Example 6 | Yes | 1,490 | 45 |
| Comparative | No | 1,230 | 32 |

TABLE 4-continued

| Comparison of properties of polybutylene terephthalate composite materials | | | |
|---|---|---|---|
| Example | Treatment of this invention | Tensile strength ($kg/cm^2$) | Tensile modulus of elasticity ($t/cm^2$) |
| Example 4 | | | |

EXAMPLE 7

The fiber obtained in Referential Example 1 was treated in 10% by weight aqueous sodium bicarbonate solution. The volume of the aqueous solution was 500 ml, the quantity of the fiber 38 g, the treating temperature 75° C. and the treating time 30 minutes.

An epoxy resin composite material was prepared in the same manner as in Example 1. The $V_f$ in this Example was 47% and ILSS was 5.6 $kg/mm^2$, which was high as compared with that in Comparative Example 1.

What is claimed is:

1. A method for treating reinforcing fibers which comprises contacting a fiber obtained from a polyester which shows anisotropy in the molten state, wherein the polyester is one which is selected from the group consisting of:

a copolyester formed of 40 to 70% by mole of a p-hydroxybenzoic acid, 15 to 30% by mole of an aromatic dicarboxylic acid, and 15 to 30% by mole of an aromatic diphenol;

a copolyester formed of at least one selected from the group consisting of terephthalic acid and isophthalic acid and at least one selected from the group consisting of chlorohydroquinone, phenylhydroquinone and hydroquinone; and a copolyester formed of p-hydroxybenzoic acid and 2-hydroxy-naphthalene-6-carboxylic acid, with an aqueous solution containing from 1 to 20% by weight of at least one compound selected from the group consisting of hydroxides, carbonates, bicarbonates, and organic carboxylic acid salts of lithium, sodium, potassium, magnesium or calcium at 60° to 100° C. for at least one minute.

2. A polyester reinforcing fiber obtained by the method according to claim 1.

* * * * *

UNITED STATES PATENT AND TRADEMARK OFFICE

CERTIFICATE OF CORRECTION

PATENT NO. : 4,758,242

DATED : July 19, 1988

INVENTOR(S) : Katsuji UENO et al

It is certified that error appears in the above-identified patent and that said Letters Patent is hereby corrected as shown below:

On the title page change:

[63] "Continuation-in-part" of Ser. No. 702,583, Feb. 19, 1985, abandoned.

to

[63] -- Continuation -- of Ser. No. 702,583, Feb. 19, 1985, abandoned.

Signed and Sealed this

Seventh Day of May, 1991

*Attest:*

HARRY F. MANBECK, JR.

*Attesting Officer*

*Commissioner of Patents and Trademarks*